United States Patent [19]

Clifton

[11] Patent Number: 4,776,124

[45] Date of Patent: Oct. 11, 1988

[54] RETRACTABLE RIFLE SUPPORT

[76] Inventor: Oland B. Clifton, 2326 Ingleside, Grand Prairie, Tex. 75050

[21] Appl. No.: 93,621

[22] Filed: Sep. 8, 1987

[51] Int. Cl.[4] ..... F41C 29/00

[52] U.S. Cl. ..... 42/94

[58] Field of Search ..... 42/94, 71.01, 72; 89/37.04

[56] References Cited

U.S. PATENT DOCUMENTS

| | | | |
|---|---|---|---|
| 64,765 | 5/1867 | Hawkins | 42/94 |
| 613,241 | 11/1898 | Burton | 42/94 |
| 716,158 | 12/1902 | Wheeler | 42/94 |
| 1,426,967 | 8/1922 | Drescher | 42/94 |
| 1,431,058 | 10/1922 | Sutter | 89/37.04 |
| 2,420,267 | 5/1947 | Sefried, 2D | 42/94 |
| 2,436,349 | 2/1948 | Adams | 42/94 |
| 2,489,283 | 11/1949 | Garand | 42/94 |
| 2,498,749 | 2/1950 | Benson | 42/71.01 |
| 2,775,052 | 12/1956 | Musser et al. | 42/94 |
| 2,807,904 | 10/1957 | Kreske | 42/94 |
| 3,327,422 | 6/1967 | Harris | 42/94 |
| 3,938,273 | 2/1976 | Tellie | 42/94 |
| 4,017,997 | 4/1977 | Peterson et al. | 42/94 |
| 4,351,224 | 9/1982 | Curtis | 89/37.04 |
| 4,359,834 | 11/1982 | Beretta | 42/94 |
| 4,397,112 | 8/1983 | York | 42/94 |
| 4,470,216 | 9/1984 | Harris | 42/94 |
| 4,625,620 | 12/1986 | Harris | 89/37.04 |

FOREIGN PATENT DOCUMENTS 2349609 4/1975 Fed. Rep. of Germany .

*Primary Examiner*—Charles T. Jordan

*Attorney, Agent, or Firm*—Gregory W. Carr

[57] ABSTRACT

The invention disclosed is a retractable support having one or more support legs secured to a rifle stock by a housing. Each support legs is stored within the rifle stock when not in use. The support legs can be slid from the end of the rifle stock to an extended position substantially parallel to the rifle stock. A hinge assembly allows pivoting of the support legs from the extended position to a support position substantially perpendicular to the rifle stock for supportin during shooting.

23 Claims, 4 Drawing Sheets

12
62
68
22
25
20
25
10
14

14
10
20
25
62
25
12

14
20
θ
10

4c
4c
θ/2

100
102
104
106
108
110
112
114
116
117
118
119
120
122
123
124
126
128
130
132
134
136
138
140
142
144
146
148
150
152
154
156
158
160
162
164
θ/2
10

RETRACTABLE RIFLE SUPPORT

TECHNICAL FIELD

This invention relates to rifle supports and, more particularly, to a rifle support which is retractable into the stock of a rifle.

BACKGROUND AND SUMMARY OF THE INVENTION

Bipods have commonly been used as supports to steady rifles during shooting. Typically, such bipods are secured to the exterior of the barrel or rifle stock, either permanently or by means of a clamp or other device allowing removal of the bipod when the rifle is not in use. Many previously known bipods also fold against the exterior of the rifle stock and barrel to facilitate transport and handling of the rifle when the bipod is not in use.

A number of undesirable features, however, are characteristic of previously known rifle bipods. For example, bipods that are removable from the rifle comprise an additional piece of equipment that must be carried and stored apart from the rifle. Bipods which fold against the rifle, on the other hand, make storage of the rifle in gun cases, rifle racks and carrying cases difficult or impossible. Moreover, collapsible bipods present an awkward and uncomfortable surface with which to hold the rifle during shooting when use of the bipod is unnecessary or unwanted.

The foregoing disadvantages associated with previously known rifle bipods are overcome by the present invention. The invention is a retractable rifle support having one or more support legs secured to a rifle stock by a housing. Each support leg is stored within a channel formed in the rifle stock when not in use. When use of the support is desired, each support leg is slid from the front end of the rifle stock through an aperture in the housing, to an extended position substantially parallel to the rifle stock. A hinge assembly then allows pivotal movement of each support leg from the extended position to a support position substantially perpendicular to the rifle stock for shooting. When the rifle is not in use, each support leg may be returned to its retracted position within the rifle stock, leaving virtually no external structure presenting irregular surfaces or obstructions to storage and handling of the rifle.

BRIEF DESCRIPTION OF THE DRAWINGS

A more complete understanding of the invention may be had by reference to the following Detailed Description when taken in conjunction with the accompanying FIGURES which illustrate the following.

DETAILED DESCRIPTION

Figures 1, 2, 11:
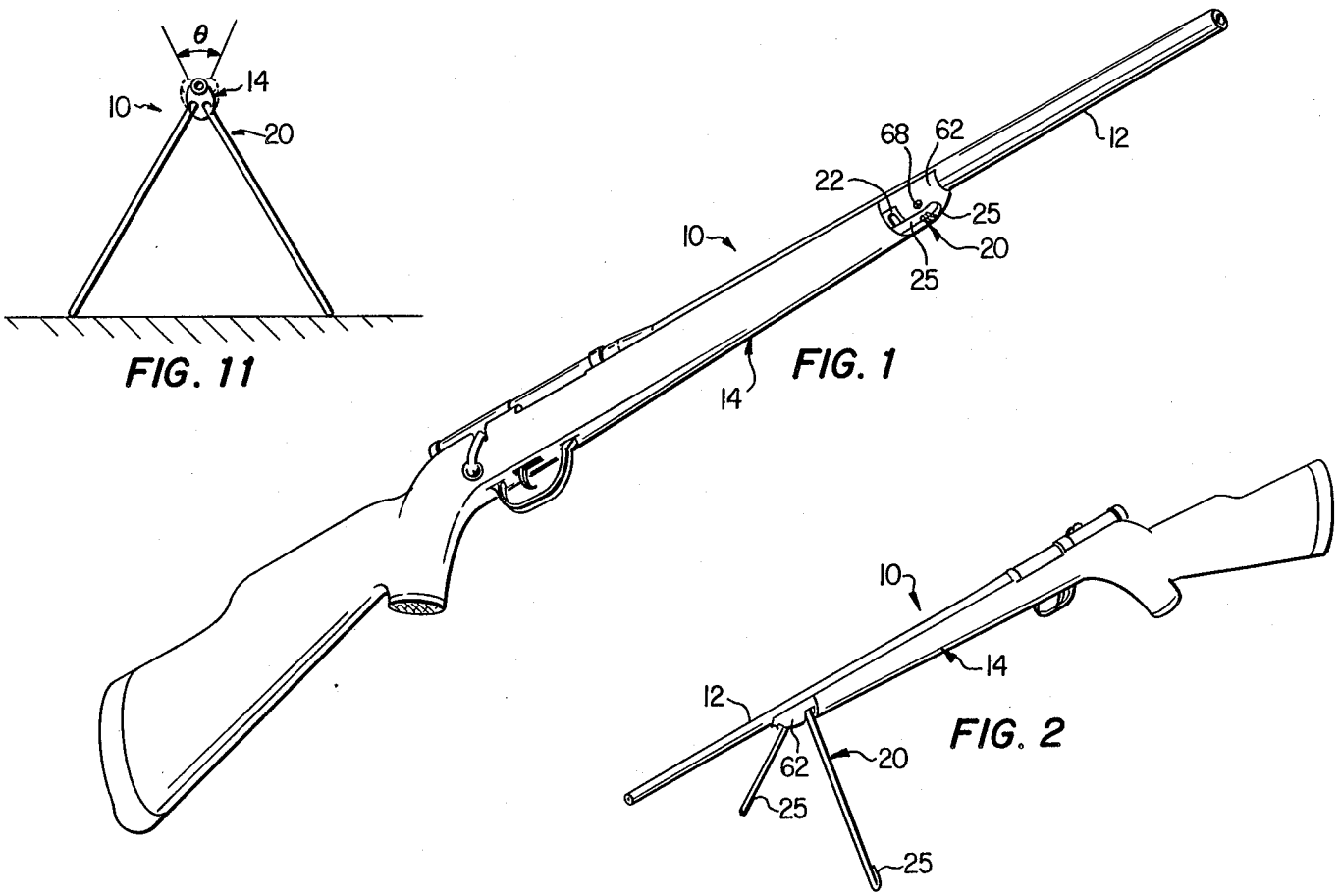
FIG. 1 is a perspective view of a rifle having a support incorporating the first embodiment of the invention, wherein the support is in a retracted position.
FIG. 2 is a perspective view of a rifle having a support incorporating a first embodiment of the invention, wherein the support is in a support position.
FIG. 11 is a front view of a rifle stock having a support incorporating the present invention, showing pivotal adjustment of the support relative to the longitudinal axis of the stock for shooting on non-level surfaces.

Shown in FIGS. 1 and 2 is a rifle 10 having a barrel 12 supported by a rifle stock 14. The rifle stock 14 is preferably manufactured from composite materials, such as fiberglass, graphite, Kevlar and the like; however, it will be appreciated that other durable materials, such as wood, may be used in its construction. Secured to the front end of the rifle stock 14 is a rifle support 20 incorporating a first embodiment of the invention. The support 20 is shown in a retracted position in FIG. 1. Prior to shooting, the rifle support 20 may be placed in the support position shown in FIG. 2 to steady the front end of the rifle 10.

Figures 3, 4A, 5A, 5B, 5C:
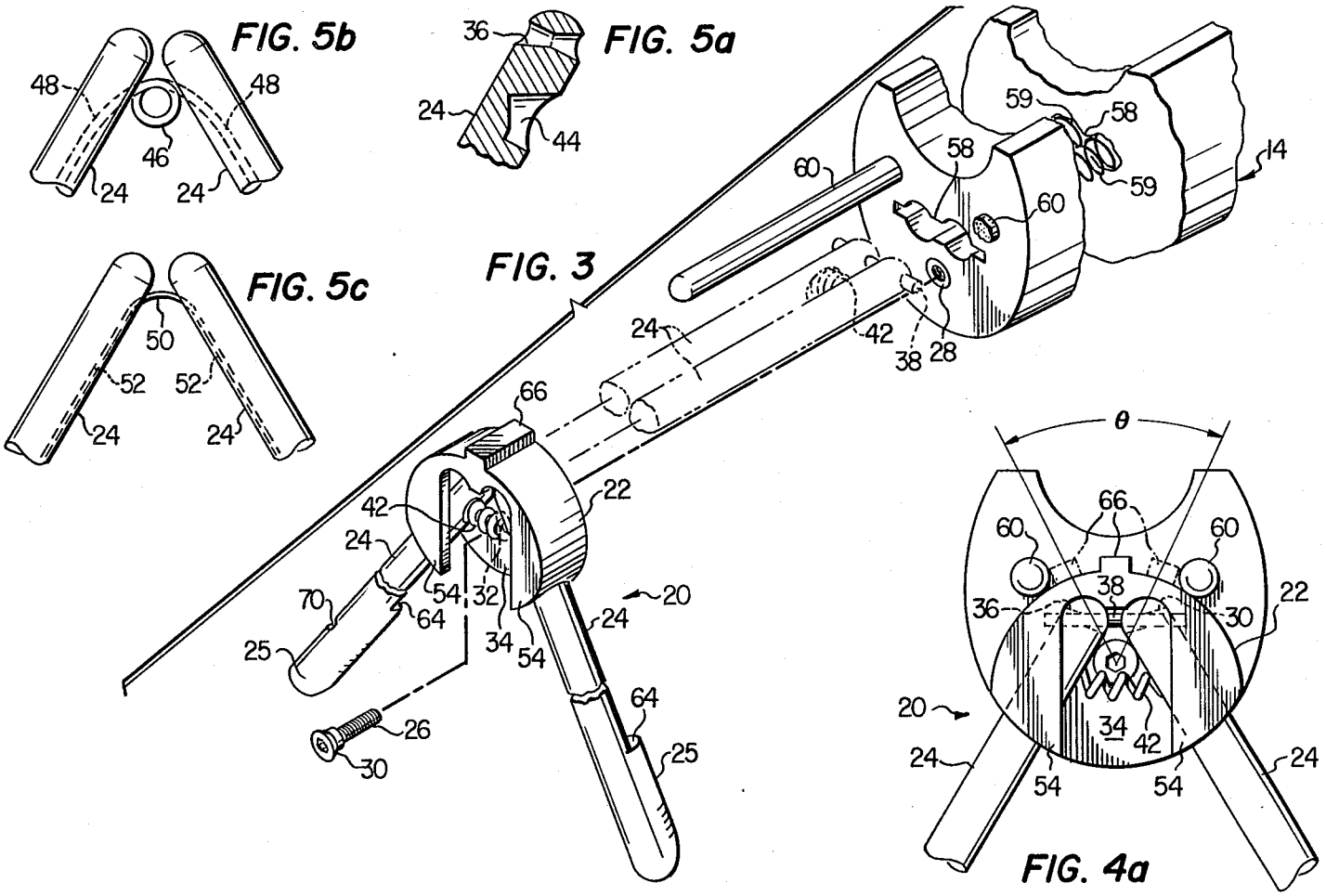
FIG. 3 is an exploded perspective view of a support incorporating a first embodiment of the invention.
FIG. 4*a* is a front view of a support incorporating a first embodiment of the invention, wherein the support is in a support position.
FIG. 5*a* is a partial sectional view of the upper end of a support leg of a first embodiment of the invention.
FIG. 5*b* illustrates the upper ends of leg supports used in a first embodiment of the invention incorporating an alternative spring design.
FIG. 5*c* illustrates the upper ends of leg supports used in a first embodiment of the invention incorporating an alternative spring design.
Figures 4B, 4C, 6A, 6B, 7:
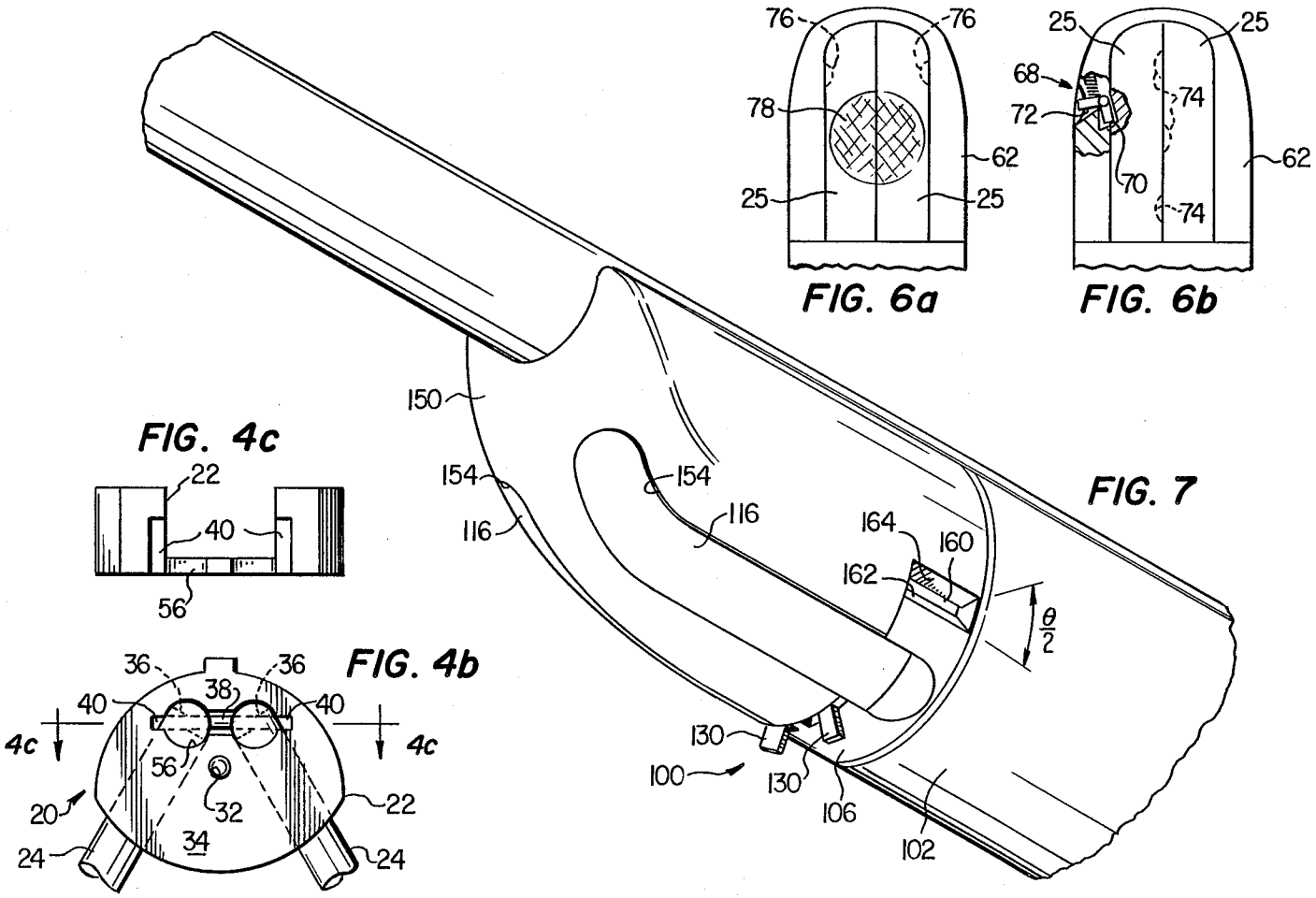
FIG. 4*b* is a view of the back of the support shown in FIG. 4*a;*
FIG. 4*c* is a sectional view of a support housing incorporating a first embodiment of the invention shown in FIG. 4*b,* taken along lines 4*c*–4*c;*
FIG. 6*a* is a bottom view of the front portion of a stock incorporating a first embodiment of the invention.
FIG. 6*b* is a bottom view of the front portion of a stock incorporating a first embodiment of the invention.
FIG. 7 is a perspective view of a portion of a rifle having a support incorporating a second embodiment of the invention, wherein the support is shown in a retracted position.

FIGS. 3, 4*a* and 4*b* illustrate the construction of the support 20. The support 20 includes a housing 22 preferably manufactured from metal, such as steel or aluminum, from composites, such as fiberglass, graphite, Kevlar and the like, or from other durable materials. The housing 22 is secured to the rifle stock 14 by means of a threaded fastener 26 which engages a threaded hole 28 in the stock 14. The thread fastener 26 includes an unthreaded shoulder portion 30 which engages a screw hole 32 through a back plate 34 of the housing 22 to provide a pivot about which the housing 22 can swivel.

Extending from the housing 22 are a pair of support legs 24. The support legs 24 are preferably composed of metal, such as steel or aluminum, of composites, such as fiberglass, graphite and the like, or of other materials that are not susceptible to bending or breaking. The distal ends of the support legs 24 form feet 25 on which the support 20 rests during use. The feet 25 are composed of any of the durable materials composing the support legs, as well as rubber or other durable materials.

Extending through adjacent hinge apertures 36 located at the upper ends of each support leg 24 is a pin 38. The ends of the pin 38 extend beyond the hinge apertures 36. When the support legs 24 are placed in the support position shown in FIGS. 3, 4*a* and 4*b*, the ends of the pin 38 engage pin receptacles 40 extending through the back plate 34 and into the body of the housing 22 to a point just beyond the center of the housing 22. The pin receptacles are, perhaps, best shown in the sectional view of FIG. 4*c*. When positioned within the pin receptacles 40, the pin 38 secures the support legs 24 to the housing 22 and acts as a hinge pin about which the support legs 24 will pivot.

FIG. 5*a* is a sectional view of the upper end of the left leg support 24 of FIG. 4*a*, illustrating the configuration of the hinge pin apertures 36. A correspondingly shaped hinge pin aperture 36 also extends through the upper end of the right support leg 24 of FIG. 4*a*. The hinge apertures 36 are flaired outwardly from a point approximately mid-way through their respective leg supports 24. This feature allows the support legs 24 to be splayed apart laterally when placed in the support position, as well as allowing the legs 24 to pivot forwardly about the pin 38.

Referring again to FIGS. 3 and 4*a*, a coil spring 42 is secured between the upper ends of the support legs 24 for urging the legs 24 apart. As is shown in FIG. 5*a*, corresponding spring receptacles 44 are formed in the upper ends of the support legs 24 below the hinge apertures 36. The ends of the coil spring 42 are inserted into and held by the spring receptacles 44.

FIGS. 5*b* and 5*c* illustrate spring designs which may be used as alternatives to the coil spring 42. FIG. 5*b* shows a torsion spring 46 coiled along an axis perpendicular to the view shown. The ends 48 of the spring 46 are embedded in slots formed into the upper ends of the support legs 24 and urge the legs 24 apart in a fashion similar to the coil spring 42. FIG. 5*c* illusratesa leaf spring 50 having spring ends 52 embedded in the support legs 24. The leaf spring 50 also urges the support legs 24 apart in a manner similar to the coil spring 42.

Referring now to FIG. 4*a*, a pair of flanges extend inwardly from the sides of the housing 22 to form receptacles into which the support legs 24 engage when splayed apart in the support position. The flanges 54 form receptacles serving as locks for preventing pivotal movement of the support legs 24 about pin 38 when the legs 24 are in the support position. To pivot the support legs 24 about the pin 38, the legs 24 must be drawn together against the force of the coil spring 42. The support legs 24 may then be pivoted upwardly between the flanges 54 into an extended position (represented by broken lines in FIG. 3), wherein the support legs 24 extend substantially parallel to the stock 14.

Once placed in the extended position, the support legs 24, the spring 46 and the pin 38 may be slid through an aperture 56 in the back plate 34 of the housing 22 into a retracted position within a storage channel 58 in the stock 14. The storage channel 58 is normally aligned with the pin receptacles 40 and aperture 56 of the housing 22. The cross section of the storage channel 58 is of sufficient length to allow substantially the entire length of the support legs 24 to be slid within the rifle stock 14.

In the event the stock 14 is manufactured of a composite, such as fiberglass, the channel 58 is preferably formed by a tool of corresponding cross section placed into the the mold prior to or during the molding process. The tool may then be removed after the fiberglass has cured. If the stock 14 is manufactured from hard materials, such as wood, the channel 58 may be formed using conventional drilling and broaching techniques.

A pair of posts 60 are secured to and extend forwardly from the rifle stock 14. The posts 60 engage correspondingly shaped and positioned poles in an end cap 62 (shown in FIGS. 1 and 2), which forms the forward end of the rifle stock 14. The end cap 62 is preferably manufactured from materials similar to that from which the rifle stock 14 is manufactured. Portions of the end cap 62 facing the rifle stock 14 (not shown) abut the gun stock 14. However, the end cap 62 is formed to accommodate the housing 22 and the feet 25 when the support legs 24 are in the retracted position within the gun stock 14, as is shown in FIG. 1.

As is shown in FIGS. 1, 3 and 4*a*, the housing 22 and the support feet 25 present surfaces substantially flush with the rifle stock 14 and the end cap 62 when in the retracted position. When the support legs 24 are fully retracted, shoulders 64 formed on the support feet 25 abut the back plate 34 of the housing 22. In this position, the support feet 25 are adjacent each other and contour of the feet 25 provide a smooth surface which does not interfere with handling or storage of the rifle 10.

Extending from the upper surface of the housing 22 is a pivot stop 66. The pivot stop 66 abuts the posts 60 as the support 20 is rotated about the threaded fastener 26, to limit swivel of the support 20 to an angle theta "$\theta$" shown in FIGS. 4*a* and 11 of approximately forty (40) degrees. Such rotation of the support 20 allows adjustment of the support 20, to allow placement of the support legs 24 on a non-level surface. As is best shown in FIG. 4*a*, the housing 22 abuts and slides across the posts 60. The posts 60 thereby form bearing surfaces supporting much of the weight of the rifles 10 on the housing 22, reducing stress placed on the fastener 26 and distributing the load held by the support 20 throughout the front end of the stock 14. It will be apparent that the housing 22 must be oriented so that the aperture 56 is aligned with the storage channel 58 before the support legs 24 can be placed in the extended position and slid into the retracted position within the stock 14.

To use the support 20, the support legs 24 are slid forwardly from their retracted position within the rifle stock 14 to an extended position in which the pin 38 engages the pin receptacles 40 of the housing 22. In the extended position, the support legs 24 extend from the housing 22 substantially parallel to the rifle stock 14. The support legs 24 are next pivoted about the pin 38 to the support position where the support legs 24 are substantially perpendicular to the rifle stock 14. The coil spring 42 then urges the support legs 24 apart into the support position shown in FIGS. 2 and 3. These steps are reversed to return the support legs 24 to the retracted position within the rifle stock 14.

As is shown in FIGS. 1 and 6*b*, the end cap 62 is provided with a spring-biased detent 68 for securing the support legs 24 in the retracted position. The detent 68 is biased toward the left support leg 24 of FIG. 3. The support leg 24 engages and displaces the detent 68 as it pivots from the support position into the extended position. As the support leg 24 is slid into the retracted position, the detent 68 engages a retaining slot 70 formed in the side of the left support foot 25, thereby serving as a means for retaining the support legs within the rifle stock 14. The detent 68 includes a release lever 72 which is manually displaced to release the support legs 24 for extension from the stock 14.

Molded or otherwise fashioned into opposing inner surfaces of the support leg feet 25 are means for aligning the feet 25 when the support legs 24 are together in the extended and retracted positions. As is shown in FIG. 6*b*, to accomplish this function, the inwardly facing surfaces of the support leg feet 25 are provided with engageable protrusions and dimples 74. By aligning the support leg feet 25, the protrusions and dimples maintain a contoured surface along the end cap 62 when the support legs 24 are retracted. Although three sets of mating dimples and protrusions are shown in FIG. 6*b*, it will be appreciated that the number and size of the protrusions and dimples may be varied. Similarly, other structures, such as engageable posts and holes, could be used in the alternative to align the support leg feet 25.

Shown in FIG. 6*a*, is an alternative means for securing the support legs 24 in the retracted position. Formed on the inwardly facing surfaces of the end cap 62 and on the outwardly facing surfaces of the support leg feet 25 are engageable protrusions and dimples 76. The protrusions extend inwardly from the end cap and are deformed outwardly by the support leg feet 25 as the support legs 24 are slid toward the retracted position. Once the support legs 24 are fully retracted, the protrusions and dimples engage to secure the support leg feet 25 in alignment within the end cap 62.

Formed in the lower surfaces of the support leg feet 25 is a finger or thumb depression 78 having a scored surface for increased friction. To release the support legs 24 from the end cap 62, users place a thumb or forefinger on the depression 78 and slide the support leg feet 25 out of engagement with the end cap 62. If desired, the means for aligning the support leg feet 25 illustrated in and discussed with respect to FIG. 6*b* may be used in combination with the securing means shown in FIG. 6*a*, to promote alignment between the support leg feet 25.

The rifle stock 14 includes an ejector means for sliding the support legs 24 from the retracted position to the extended position upon release of the detent 68. The ejector means comprises a pair of springs 59 secured within the storage channel 58, which urge the support legs 24 toward the extended position. Upon release of the support leg feet 25 from the end cap 62, the ejector means slide the support legs 24 forward into the extended position. The support legs 24 then pivot toward the support position under the force of gravity. Once substantially perpendicular to the rifle stock 14, the support legs 24 are splayed apart by the coil spring 42 into the support position shown in FIGS. 2 and 3. This feature allows the support 20 to be employed while holding the rifle 10 in a ready position, without users needing to release or move their grip on the stock 14.

Referring now to FIGS. 7, 8, 9 and 10, there is shown a rifle support 100 incorporating a second embodiment of the invention. The support 100 is secured to a rifle stock 102 preferably manufactured from composites, such as fiberglass, graphite, Kevlar and the like; however, it will be appreciated that other durable materials, such as wood, may be used in its construction. The support 100 is shown in FIG. 7 in a retracted position. In use, the support 100 is positioned in a support position, wherein a pair of support legs 104 are positioned substantially perpendicular to the stock 102, in a relationship similar to support legs 25 in FIG. 2.

The support 100 includes a housing 106, which is secured to the stock 102 by a post 108. The post 108 is rigidly secured to the rifle stock 102 within a hole 110 by epoxy, adhesive or other suitable means. The housing 106 includes a pivot hole 112 through which the post 108 extends. The diameter of the pivot hole 112 is sufficiently larger than the diameter of the post 108 to allow swiveling of the housing 106 and support legs 104 relative to the rifle stock 102. The housing 106 is preferably manufactured from metal, such as steel or aluminum, from composites, such as fiberglass, graphite, Kevlar and the like, or from other durable materials.

The housing 106 secures the support legs 104 to the rifle stock 102. The support legs 104 are preferably manufactured from metal, such as steel or aluminum, from composites, such as fiberglass, graphite and the like, or from other materials that are not susceptible to bending or breaking. Formed on opposite sides of each support leg 104 are a pair of guide grooves 114. The guide grooves 114 extend along substantially the entire length of each support leg 104. Formed at the distal end of each support leg 104 is a foot 116 on which the support 100 rests during use. The feet 116 are preferably manufactured from any of the durable materials composing the support legs, as well as rubber or other durable materials.

The guide grooves 114 of the support legs 104 are engaged by inner and outer pins 117 and 118. The inner pins 117 are press-fitted into forwardly extending flanges 120 of the housing 106 or may be formed integrally with the housing 106 by molding. The outer pins 118 are thread-mounted to the housing in holes 123.

Figures 8, 9, 10:
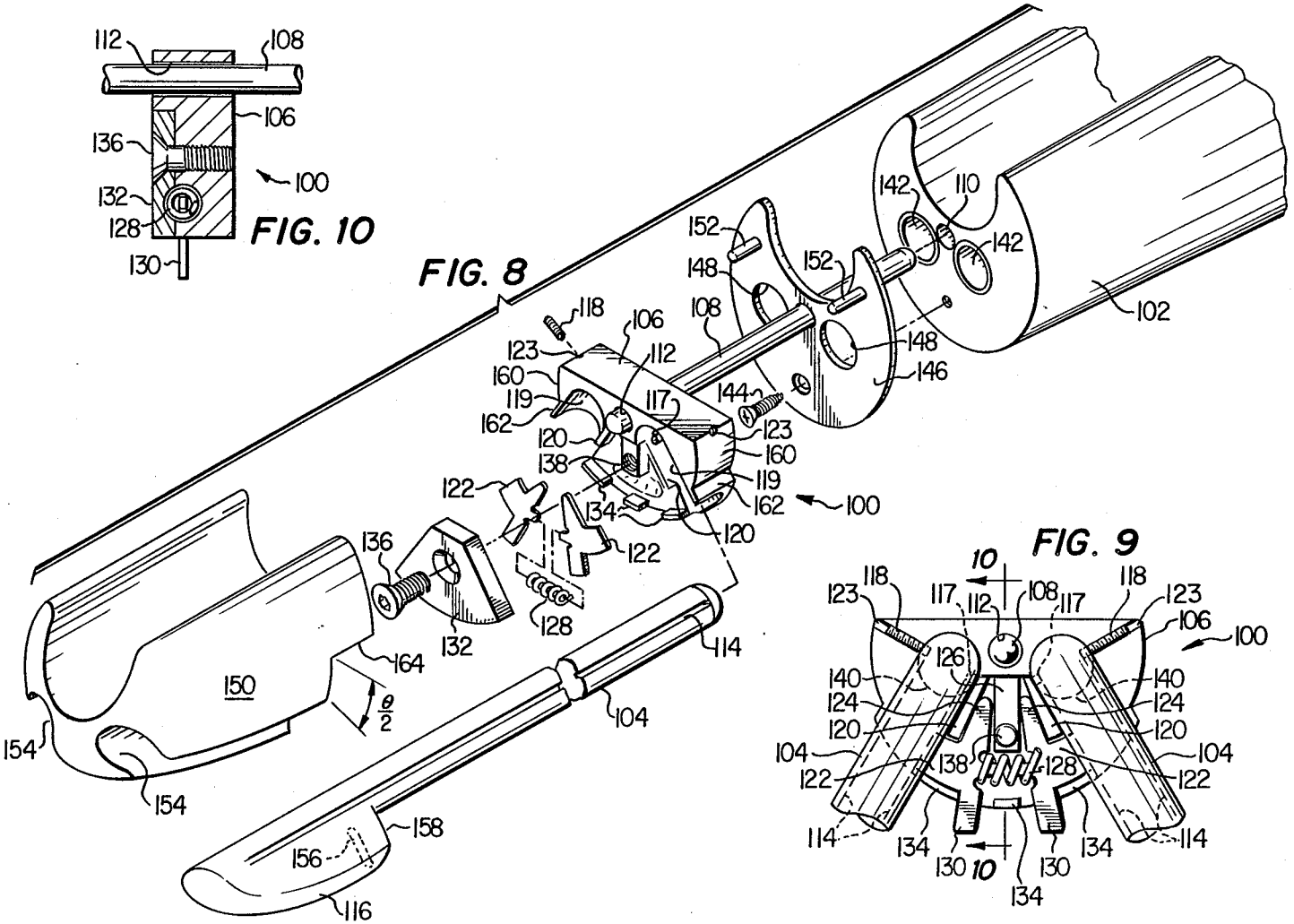
FIG. 8 is an exploded perspective view of a support incorporating a second embodiment of the invention.
FIG. 9 is a partial front view of a support incorporating a second embodiment of the invention, wherein the support is in a support position.
FIG. 10 is a sectional view of the support shown in FIG. 9, taken along section lines 10—10.

In the support position shown by FIG. 9, the inner and outer pins 117 and 118 abut the upper ends of the guide grooves 114, thereby pivotally supporting the support legs 104 for pivotal movement with respect to the housing 106. Placement of the inner pins below the outer pins causes the support legs 104 to pivot from an extended position (shown in FIG. 8), substantially parallel to the rifle stock 102, to a support position (shown in FIG. 9), wherein the support legs 104 are substantially perpendicular to the rifle stock 102 and splayed apart approximately sixty (60) degrees to enhance stability during shooting. The housing 106 forms inner surfaces 119 against which the upper ends of the support legs 104 bear for additional stability in the support position.

The support legs 104 are secured in the support position against upward pivoting into the extended position by pair of detents 122. Each detent 122 includes a pivot section 124 abutting and pivoting against a flange 120 and a spacer 126 formed at the center of the housing 106. A coil spring 128 is secured between the detents 122 and urges them outwardly toward the support legs 104. As the support legs 104 pivot from the extended position to the support position shown in FIG. 9, the support legs 104 abut and displace their respective detent 122 inwardly. When the support legs 104 reach the support position, the detents 122 align with and insert into the inner guide grooves 114, securing the support legs 104 against pivotal movement. The support legs 104 are released from the detents 122 by manually squeezing together release levers 130 extending downwardly from the detents 122, thereby displacing the detents 122 inwardly and out of engagement with the inner guide grooves 114.

As is shown in FIGS. 8 and 10, the detents 122 and coil spring 128 are secured within the housing 106 by a cover plate 132. The cover plate 132 engages and is supported by the flanges 120, the spacer 126 and spacers 134 located at the bottom of the housing. The cover plate 132 is secured to the housing 106 by a bolt 136 which engages a threaded aperture 138 in the spacer 126.

Extending through the housing 106 are a pair of apertures 140 shown by broken lines in FIG. 9. The apertures 140 are aligned with the inner and outer pins 117 and 118 and are sized to allow the leg supports 104 to slide through the housing 106. Aligned with the apertures 140 are a pair of storage channels 142 formed in the rifle stock 102, either by drilling or by a mold insert, if the rifle stock 102 is manufactured from molded composites. The storage channels 142 are of sufficient length to receive the leg supports 104.

Interposed between the rifle stock 102 and housing 106, and secured to the stock 102 by means of a screw 144, is a face plate 146 having a pair of apertures 148. The apertures 148 are also aligned with the apertures 140 of the housing 106 to allow insertion of the support legs 104 into the stock 102. The face plate 146 lends support to the post 108 to avoid breakage of the walls of the hole 110 extending adjacent the storage channels 142. To further minimize the possibility of such breakage, the storage channels 142 may be lined with a tube manufactured from aluminum, hard plastic or other similar material.

To position the support legs 104 within the stock 102 in a retracted position, the support legs 104 are pivoted about the inner and outer pins 117 and 118 into the extended position shown in FIG. 8. In the extended position, the support legs 104 are aligned with the apertures 140 of the housing 106 and the storage channels 142 of the rifle stock 102. The support legs 104 are then slid into the storage channels 142, through the housing 106 and face plate 146. As the support legs 104 are inserted into the stock 14 and into the housing 106, the guide grooves 114 slide over the inner and outer pins 117 and 118 of the housing.

Secured in front of the housing 106 and to the post 108 is an end cap 150. The end cap 150 forms the front end of the stock 102. The end cap 150 is secured against rotation on the post 108 by two posts 152 mounted to the stock 102 and extending through apertures in the face plate 146. The posts 152 engage corresponding holes (not shown) in the end cap 150.

Formed into the lower surface of the end cap 150 are a pair of receptacles 154. The receptacles 154 are normally aligned with the apertures 140 of the housing 106 and the storage channels 142 of the stock 102. The receptacles 154 receive the support legs 104 as they are placed in the extended position from the retracted or support position. As is best shown in FIG. 7, the exterior surfaces of the feet 116 of the support legs 104 and the lower exterior surfaces of the housing 106 are contoured to be flush with the surfaces of the end cap 150 and the stock 102 when the support legs 104 are in the retracted position.

Each of the feet 116 have a notch 156 formed on its inner surfaces, positioned for engagement with the detents 122 of the housing 106. As the support legs 104 are slid into the retracted position, the detents 122 contact contoured shoulders of the support leg feet 116, which displace the detents 122 together, allowing the feet 116 to pass into the housing 106. The notches 156 are positioned to align with the detents 122 when the support legs 104 are fully retracted, at which point the detents 122 engage the notches 156 to restrain the support legs 104 in the retracted position.

The stock 102 is also provided with a means for ejecting the support legs 104 into the extended position upon release of the detents 122. This is accomplished by securing coil springs (not shown) within each of the storage channels 142. The ends of the support legs 104 abut and compress the ejection springs when slid into the retracted position. Upon release of the detents 122 from the feet 116 of the support legs 104, the springs within the storage channels 142 propel the support legs 104 into the extended position. From the extended position, the support legs 104 pivot under the influence of gravity into the support position shown in FIG. 9, into engagement with the detents 122. This feature allows the support 100 to be employed while holding the rifle and stock 102 in a ready position, without users needing to release or move their grip on the stock 102.

Once in the support position, the support 100 can be pivoted about the post 108 to adjust the support legs 104 for shooting on non-level terrain. The degree of rotation afforded the support 100, preferrably approximately forty (40) degrees, is represented by the angle theta "$\theta$" in FIG. 11. As is best shown in FIGS. 6 and 7, the housing 106 has curved lateral surfaces 160 which terminate at outwardly extending housing stops 162. When the support 100 and the end cap 150 are mounted to the rifle stock 102, the lateral surfaces 160 move freely within the end cap 150.

The rotation of the support 100, however, is limited both by stops 164 (only one shown) formed on the end cap 150, which abut the housing stop 162 to limit rotation of the support 100, and by the posts 152, which the housing 106 abuts at the same time the housing stops 162 abut the stops 164. The angular separation between the housing stop 162 and the stop 164, relative to the post 108, is approximately one-half of the angle theta ("$\theta/2$"). It will be apparent that the housing 106 must be oriented with its apertures 140 in alignment with the storage channels 142 of the stock before the support legs 104 can be placed in the extended position and slid into the retracted position within the stock 102.

Although preferred embodiments of the invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A retractable gun support comprising:

one or more leg supports for supporting a gun in a substantially horizontal position during shooting;

housing means for securing each leg support to the front portion of a gun stock for sliding along a path substantially parallel to the gun stock from a retracted position within the gun stock to an extended position outside the gun stock; and hinge means for pivoting each support leg at the housing means downwardly from the extended position to a support position, wherein each support leg is substantially perpendicular to the gun stock, for shooting.

2. The retractable gun support of claim 1 further comprising a releasable retaining means for securing each leg support in the retracted position within the gun stock when not in use.

3. The retractable gun support of claim 2 further comprising spring means for ejecting each leg support from the retracted position to the extended position upon release of the leg support retaining means.

4. The retractable gun support of claim 1 further comprising a lock means for securing each leg support in the support position for shooting.

5. The retractable gun support of claim 1 further comprising pivot means for securing the housing means to the gun stock for pivotal movement about an axis substantially parallel to the gun stock to allow adjustment of the support for use on non-level surfaces during shooting.

6. The retractable gun support of claim 1 wherein two leg supports are secured to the housing means for supporting the gun in a substantially horizontal position during shooting and wherein the hinge means allows splaying of the lower ends of the support legs laterally apart when the legs are in the support position to increase stability during shooting.

7. The retractable gun support of claim 6 further comprising:

spring means for urging the support legs toward a splayed position when the support legs are in the support position; and lock means for preventing pivotal movement of the support legs from the support position to the extended position while the support legs are splayed apart.

8. The retractable gun support of claim 6 wherein the hinge means includes a hinge pin passing through adjacent apertures in the upper ends of the support legs and wherein the diameters of the outer portions of each aperture are substantially greater than the diameter of the pin to allow splaying of the lower ends of the support legs.

9. The retractable gun support of claim 8 wherein the ends of the hinge pin extend beyond the apertures of the support legs and engage the housing means as the support legs are slid into the extended position to secure the upper ends of the support legs for pivotal movement toward the support position.

10. The retractable gun support of claim 1 wherein two leg supports are secured to the housing means for supporting the gun in a substantially horizontal position during shooting and wherein the hinge means are oriented to splay the lower ends of the support legs apart as the support legs are pivoted to the support position, to provide added stability during shooting.

11. The retractable gun support of claim 10 wherein the housing means includes one or more apertures through which each support leg slides, wherein each support leg includes two grooves extending along the length of travel of the leg through the aperture of the housing means, wherein the hinge means includes two hinge pins mounted to the housing means within each aperture and engaging the grooves of each support leg, and wherein the hinge pins abut the ends of the leg support grooves as the legs reach the extended position and support the legs for pivotal movement into the support position.

12. A gun stock with integral retractable bipod support comprising:

a gun stock having a storage channel for receiving a pair of support legs;

a housing secured to the front portion of the gun stock having an aperture therethrough aligned with the storage channel of the gun stock;

a pair of support legs secured to the gun stock by the housing for sliding through the housing aperture from a retracted position within the gun stock storage channel to an extended position wherein the support legs extend forwardly from the support housing substantially parallel to the gun stock; and a hinge member secured to the rearward ends of the support legs for engaging the housing when the support legs are moved to the extended position, for pivoting the support legs from the extended position to a support position substantially perpendicular to the gun stock, and for pivoting the distal ends of the support legs to a splayed apart position for support during shooting.

13. The gun stock of claim 12 further comprising spring means for urging the distal ends of the support legs apart.

14. The gun stock of claim 13 wherein the housing includes lock means for securing the support legs against pivoting once splayed apart in the support position.

15. The gun stock of claim 14 wherein the lock means includes a pair of receptacles formed by the housing which receive the hinged portions of the support legs when the legs are splayed apart in the support position.

16. The gun stock of claim 12 wherein the housing is pivotally secured to the gun stock for pivotal movement about the axis of the stock to allow adjustment of the support legs for use on non-level surfaces during shooting.

17. The gun stock of claim 12 further comprising a releasable retaining means for securing the support legs within the stock in the retracted position.

18. The gun stock of claim 17 further comprising ejector means for sliding the support legs from the retracted position to the extended position upon release of the retaining means.

19. A gun stock with integral retractable bipod support comprising:

a gun stock having storage channel means for receiving a pair of support legs;

a housing secured to the front portion of the gun stock having an aperture therethrough aligned with the storage channel means of the gun stock;

a pair of support legs each secured within one of the housing apertures for sliding movement from a retracted position within the gun stock storage channel means to an extended position wherein the support legs extend forwardly from the support housing substantially parallel to the gun stock;

hinge means secured to the housing for pivoting the support legs from the extended position to a support position wherein the support legs are splayed laterally apart and are substantially perpendicular to the gun stock for support during shooting.

20. The gun stock of claim 19 wherein each support leg includes a pair of guide grooves on opposing sides of the leg defining the length of travel of each leg between the retracted and extended positions, wherein the hinge means includes a pair of hinge pins secured to and extending from opposing sides of each aperture into engagement with the guide grooves of the support legs and wherein the hinge pins abut the ends of the guide grooves as the support legs reach the extended position to secure the support legs against detachment from the housing and to allow pivotal movement of the support legs to the support position for shooting.

21. The gun stock of claim 20 further comprising lock means secured to the housing for engaging at least one guide groove of each support leg as the leg is pivoted to the support position and securing the leg against pivotal movement toward the extended position.

22. The gun stock of claim 20 further comprising releasable retaining means for securing the support legs within the gun stock in the retracted position.

23. The gun stock of claim 22 further comprising ejector means for sliding the support legs from the retracted position to the extended position upon release of the leg support retaining means.

* * * * *